US009028166B2

(12) United States Patent
Morgan et al.

(10) Patent No.: US 9,028,166 B2
(45) Date of Patent: May 12, 2015

(54) WEDGE-SHAPED VEHICLE BARRIER WITH SLING

(75) Inventors: Mark Morgan, Franklin, TN (US); Jeremy Campbell, LeVergne, TN (US)

(73) Assignee: FutureNet Security Solutions, LLC, Franklin, TN (US)

( * ) Notice: Subject to any disclaimer, the term of this patent is extended or adjusted under 35 U.S.C. 154(b) by 8 days.

(21) Appl. No.: 13/586,017

(22) Filed: Aug. 15, 2012

(65) Prior Publication Data

US 2013/0045047 A1 Feb. 21, 2013

Related U.S. Application Data

(60) Provisional application No. 61/523,535, filed on Aug. 15, 2011.

(51) Int. Cl.
*E01F 13/08* (2006.01)
*E01F 13/12* (2006.01)

(52) U.S. Cl.
CPC ..... *E01F 13/08* (2013.01); *E01F 13/12* (2013.01)

(58) Field of Classification Search
CPC ..... E01F 13/04; E01F 13/06; E01F 13/08; E01F 13/10; E01F 13/12; E01F 15/146; E01F 15/086; E01F 15/083
USPC ..... 404/6, 10
See application file for complete search history.

(56) References Cited

U.S. PATENT DOCUMENTS

| | | | | |
|---|---|---|---|---|
| 4,828,424 | A * | 5/1989 | Crisp, Sr. | 404/6 |
| 4,861,185 | A * | 8/1989 | Eikelenboon | 404/6 |
| 7,114,874 | B2 * | 10/2006 | Burns et al. | 404/6 |
| 7,118,304 | B2 * | 10/2006 | Turpin et al. | 404/6 |
| 7,132,952 | B2 * | 11/2006 | Leyden et al. | 340/635 |
| 7,320,557 | B1 * | 1/2008 | Potter | 404/6 |
| 8,439,594 | B1 * | 5/2013 | Clark et al. | 404/6 |
| 2003/0133749 | A1 * | 7/2003 | Russell | 404/6 |
| 2005/0214072 | A1 * | 9/2005 | Turpin et al. | 404/6 |
| 2006/0078378 | A1 * | 4/2006 | Burns et al. | 404/6 |
| 2007/0068079 | A1 * | 3/2007 | Morgan et al. | 49/49 |
| 2008/0232901 | A1 * | 9/2008 | Burns et al. | 404/6 |
| 2008/0232902 | A1 * | 9/2008 | Burns et al. | 404/6 |
| 2010/0003078 | A1 * | 1/2010 | Huang et al. | 404/6 |
| 2010/0196093 | A1 * | 8/2010 | Seeglitz et al. | 404/6 |
| 2011/0097147 | A1 * | 4/2011 | Castro et al. | 404/6 |
| 2011/0164920 | A1 * | 7/2011 | Morgan et al. | 404/6 |
| 2011/0217115 | A1 * | 9/2011 | Thompson et al. | 404/6 |
| 2012/0112482 | A1 * | 5/2012 | Babinchak | 294/74 |

* cited by examiner

*Primary Examiner* — Abigail A Risic

(57) ABSTRACT

A wedge-shaped vehicle barrier, including a top assembly pivotably coupled to a bottom assembly; a mechanism coupled to the top assembly and coupled to the bottom assembly, where the mechanism moves the top assembly between a first position that is substantially horizontal and a second position at a first angle; and one or more flexible slings coupled to a distal portion of the top assembly and a distal portion of the bottom assembly, where the one or more slings prevent the top assembly from rotating beyond a second angle when the top assembly is engaged by a vehicle, the second angle being greater than or equal to the first angle.

36 Claims, 15 Drawing Sheets

WEDGE-SHAPED VEHICLE BARRIER WITH SLING

This application claims priority from U.S. Provisional Application Ser. No. 61/523,535 filed on Aug. 15, 2011, which is incorporated by reference in its entirety herein.

BACKGROUND

This invention relates to a wedge-shaped vehicle barrier with flexible sling that may stop an errant vehicle. The vehicle barrier may be used in a variety of applications, including traffic control and security gates.

Currently commercially available wedge-shaped vehicle barriers use steel chains or steel linkages to anchor a wedge plate to a wedge foundation. While these steel chains and linkages may provide adequate strength during a vehicle impact, they also present various problems for both the wedge designer and wedge customer, such as high weight, susceptibility to corrosion, high noise when raising and lowering the wedge plate, and high part-to-part length variation, as discussed below.

Steel chains and linkages are heavy and require higher power mechanisms to lift the chains and wedge plate. Steel chains and linkages are often painted, powder-coated or galvanized. This provides only temporary corrosion protection for these components due to their exposure to the elements and the abrasive rubbing action they experience as the wedge cycles between open and closed positions.

As the wedge barrier opens and closes, the steel chain linkages will rattle against themselves and against other components in the wedge barrier. This chain noise is significant and creates a nuisance for security and other personnel stationed nearby. This noise also creates a less-desirable perception of wedge barriers that are installed at highly aesthetic and image conscious sites, such as corporate office buildings and data centers. Some wedge manufacturers place a rubber mat or similar sound-deadening material in the bottom of the wedge foundation in an attempt to reduce chain noise. Such mats or materials have no impact on reducing the sound of the steel chain linkages rattling against themselves, and such mats or materials become submerged in rain or runoff water causing them to rot over time.

Commercially available chains have significant part-to-part linkage variations in length as a consequence of the manufacturing process. As most wedges have four or more chains, the length variation between those chains results in non-uniform loads on each chain and across the wedge plate during open/closed cycling and during an impact, which causes the chains to wear more quickly and unevenly increasing maintenance and repair costs, as well as potentially damaging the chains and barrier and reducing the barrier's performance during operation and impact.

The wedge-shaped vehicle barrier with sling of the present disclosure may overcome these problems by using a high-strength, light-weight, low-noise, flexible sling that can be manufactured to more precise length tolerances in place of steel chains or linkages. There are several advantages the sling of the present disclosure may have as compared to a wedge that uses metal chains.

First, the ability to manufacture slings with more precise length tolerances enables each sling to wear more consistently and evenly and allows more uniform loads to be placed on each sling and across the wedge plate. Second, the slings are easier to install and replace due to their light weight and manageability. Third, chain linkages may "lock up" when changing position. For example, links in a chain may shift and may not immediately slide back into the ideal operating position when the wedge plate is raised. This causes the chain to "lock up" or "kink." A sling meanwhile does not have a metal link to "lock up." The rope-like fiber of the sling naturally orients into the ideal operating position when a wedge opens and closes. Fourth, fatigue and cracking in chains is often difficult to detect while any abrasion or wear on the sling is more noticeable and more gradual. Accordingly, a fatigued chain may suddenly fail and break without any prior warning, meaning the chain will no longer be useable and potentially requiring the barrier to be removed from service until a new chain can be installed. However, fatigue and wear on a sling can be noticed sooner (while still functioning for a period of time unlike metal chains) and replaced prior to failure. Fifth, slings are much lighter than steel chains, making them easier to replace and potentially requiring less power to raise the wedge plate. Sixth, slings are much less susceptible to corrosion over time. Finally, slings significantly reduce the operating noise generated by a wedge barrier as the barrier plate is raised and lowered, eliminating the resulting nuisance.

SUMMARY OF THE DISCLOSURE

A wedge-shaped vehicle barrier, including a top assembly pivotably coupled to a bottom assembly; a mechanism coupled with the top assembly that moves the top assembly between a first position that is substantially horizontal and a second position at a first angle; and one or more flexible slings coupled to a distal portion of the top assembly and a distal portion of the bottom assembly, where the one or more slings prevent the top assembly from rotating beyond a second angle when the top assembly is engaged by a vehicle, the second angle being greater than or equal to the first angle.

DETAILED DESCRIPTION

Figure 1:
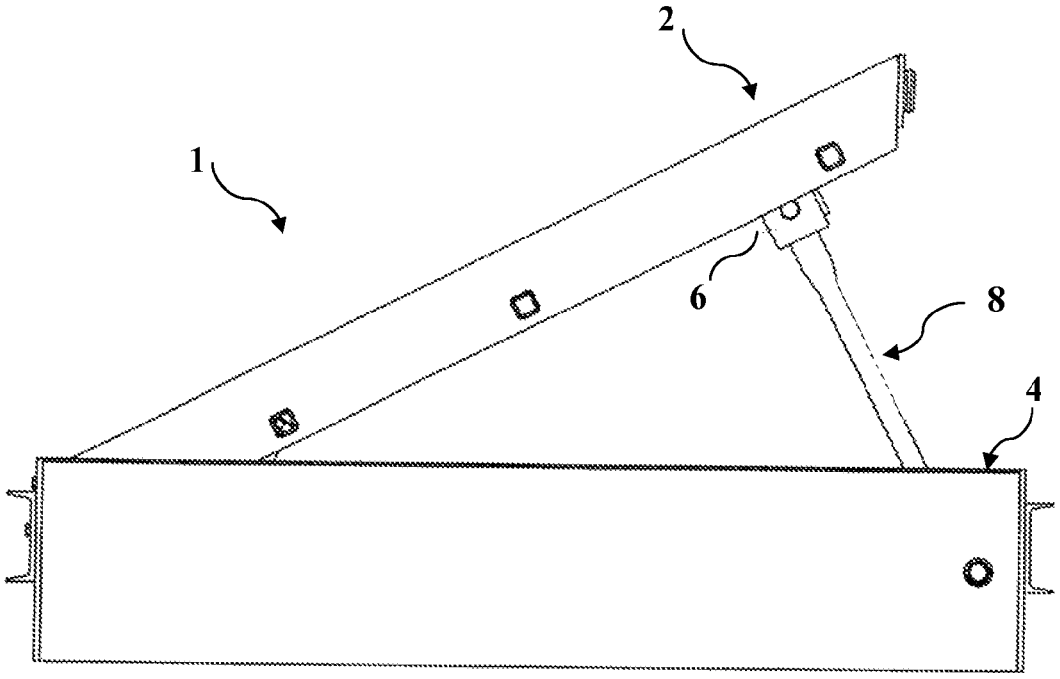
FIG. 1 shows a side view of a wedge barrier in an open position according to an aspect of the present disclosure.

The enclosure of the present disclosure may be described in detail using the accompanying drawings, wherein like reference numerals represent identical or corresponding parts throughout the several views.

FIG. 1 shows a side view of a wedge barrier 1 in an open position according to an aspect of the present disclosure. Top assembly 2 may be pivotably coupled to bottom assembly 4 and may have an upright or open position, which may engage and impair the progress of a vehicle, and may have a down or closed position in which a vehicle may drive overtop the wedge barrier 1 without significant incident. Sling 8 may be coupled to upper sling connection 6 of top assembly 2 and also coupled to lower sling connection 18 (shown in FIG. 2) of bottom assembly 4.

In one aspect, top assembly 2 can move from a closed position (e.g., substantially horizontal) to and including an upright or open position (e.g., at an angle approximately 27 degrees from horizontal). In the upright position, the top portion of top assembly 2 may be, for example, approximately 37 inches high. One of skill in the art will recognize that the angles for the closed and open position as well as the height of the top portion can be any number which would be suitable for the disclosure herein. In another aspect, if the wedge barrier 1 is struck or engaged by a vehicle, sling 8 can prevent top assembly 2 from rotating beyond the upright position. Sling 8 length defines the open position with some plus or minus (e.g., ±1.2) at impact due to sling 8 stretching.

In an additional aspect, sling 8 may be a high-strength, lightweight, synthetic sling constructed of high-performance polyethylene fiber yarns. One example of such a fiber is Spectra® 1000 grade ballistic fiber by Honeywell. One of skill in the art will recognize that several different materials can be used which would be suitable for the disclosure herein. Spectra may be combined, for example, and twisted with additional materials, for example Technora® by Teijin Techno Products Ltd. Corp. and tracer yarn. One of skill in the art will recognize that several different materials can be combined and twisted which would be suitable for the disclosure herein.

The twisted combination may be wound into a loop in one aspect, for example, approximately 53 times (to attain, for example, approximately 200,000 lbs of strength) or any other suitable number of loops (e.g., to attain the desired strength) consistent with the disclosure herein, and may be oriented such that the wound loop can be in parallel with the direction of the vehicle or load to be applied. The wound loop can exist on a different plane than the direction of the vehicle to be applied.

Figure 2:
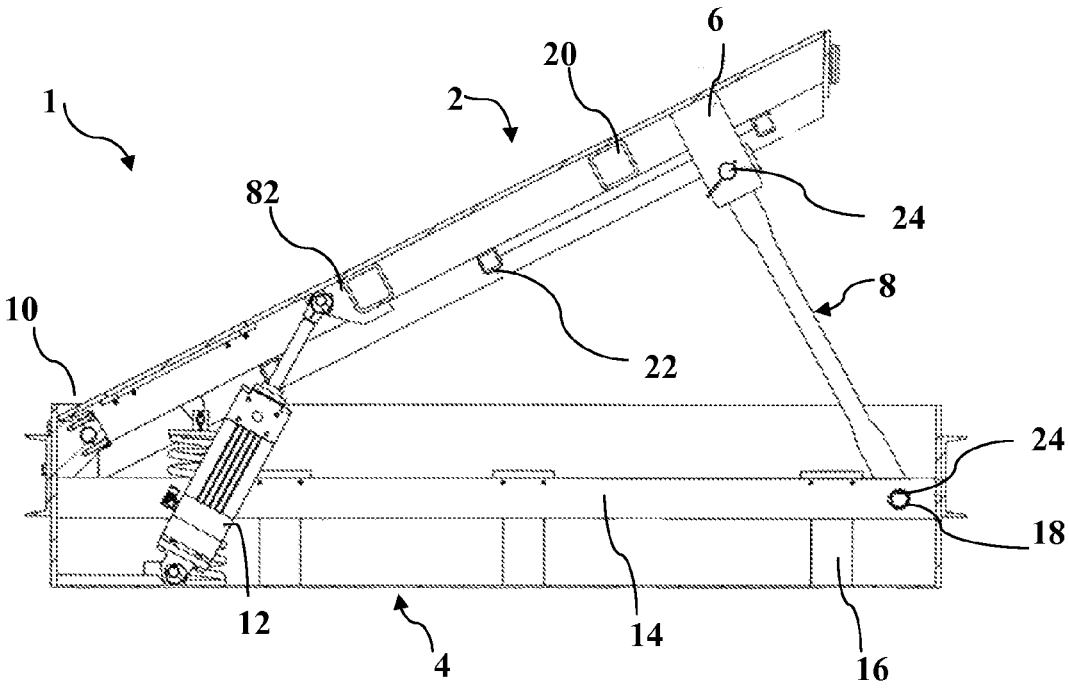
FIG. 2 shows a side cross-section view of a wedge barrier in an open position according to an aspect of the present disclosure.

A portion of the loop in another aspect may be encased in one or more layers of weather and wear resistant material 8B (shown in FIG. 12), for example, Cordura™ by Invista, creating two loop ends 8A (shown in FIG. 12) such that pins 24 (shown in FIG. 2) may be placed through each of the two end loops 8A of sling 8 thereby coupling sling 8 to upper sling connection 6 and lower sling connection 18 (shown in FIG. 2). Loop ends 8A may be in a further aspect covered in weather and wear resistant material 8B. In a another aspect, sling 8 may be naturally corrosion resistant and may require no additional protective coating. Unlike metal chains, the sling 8 may not corrode over time.

In one aspect, sling 8 could reduce noise when the wedge moves between open and closed position due to the nature of the sling 8 material. For example, when raising or lowering wedge barrier 1, metal chains could produce more noise than sling 8.

Sling 8 may be lightweight compared to steel chains or linkages. In one example, the sling 8 could be approximately 10-13% of the weight of a comparable steel chain of the same length (e.g., sling 8 may weigh approximately 4 lbs while a steel chain from wedges in the industry may weigh approximately 30 to 40 lbs). Some wedges may use a minimum of 4 steel chains while larger wedges may use more.

In another aspect, the unique combination of the top assembly 2 and sling 8 disclosed herein could cause reduced inertia. The top assembly 2 can be coupled to bottom assembly 4 via a proximate position (e.g., pivot point 10) and also via a coupling device, for example sling 8, at an opposite or distal end of top assembly 2 from the proximate position. Sling 8 in a further aspect can be set back from the edge of top assembly 2 to (a) mitigate damage to sling 8 and its connections on impact; (b) make the angle of attachment of sling 8 to top assembly 2 approximately perpendicular, which could maximize the contributing strength of sling 8; and (c) reduce the power requirement to lift top assembly 2.

The shorter distance of the coupling device to the pivot point 10, for example, could amplify the weight savings and thus reduce the power required to lift top assembly 2. The further away from the pivot point 10 that sling 8 is on top assembly 2, the more power is required to lift it. The reduced power required can result in greater lifting speeds, faster lifting times, smaller hydraulic lifting cylinders and/or smaller electric actuators used to lift top assembly 2. In one aspect, use of sling 8 may require approximately 12% less power to lift top assembly 2 than compared to steel chains or linkages. As a result, use of sling 8 may permit operation with lower electric power (e.g., an electric actuator or with lower fluid pressure in hydraulic cylinders).

Sling 8 may have less part-to-part length variation compared to steel chains or other materials, because chains are cut or made to reduced manufacturing tolerances and standards while the sling 8 can be wound in a loop of specific length. With less part to part variation, among sling 8 used in a particular wedge, the loads or vehicles applied to the top assembly 2 may be uniformly distributed and thus creating less wear (or damage) and increase performance.

FIG. 2 (which was discussed previously) shows a side cross-section view of a wedge barrier 1 in an open position according to an aspect of the present disclosure. Mechanism 12 can be coupled to top assembly 2 and bottom assembly 4 to raise and lower top assembly 2. Mechanism 12 may be electrical (discussed for example in FIG. 9 further below), hydraulic (discussed for example in FIG. 8 further below), pneumatic, mechanical, or other mechanism, and may be assisted mechanically or otherwise, for example, by a spring or load. Mechanism 12 may be controlled by a control system (not shown), which may allow user-operated and/or automated control through a variety of measures, for example, wireless communications, radio waves, direct connection to another device, and clock control preset within the mechanism.

Figure 8:
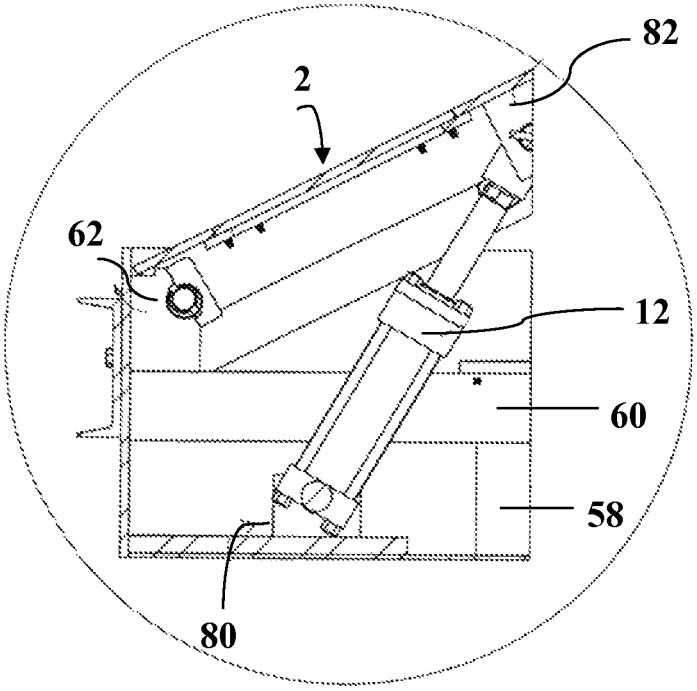
FIG. 8 shows a side cross-section view of a hydraulic raising and lowering mechanism according to an aspect of the present disclosure.

The top assembly 4 can also couple to upper tube braces 20 and lower tube braces 22 (discussed in FIG. 5) and tabs 82 (discussed in FIG. 8). The bottom assembly 4 can be coupled to apertures 16 and reflectors 14 (discussed in FIG. 3).

Figure 3:
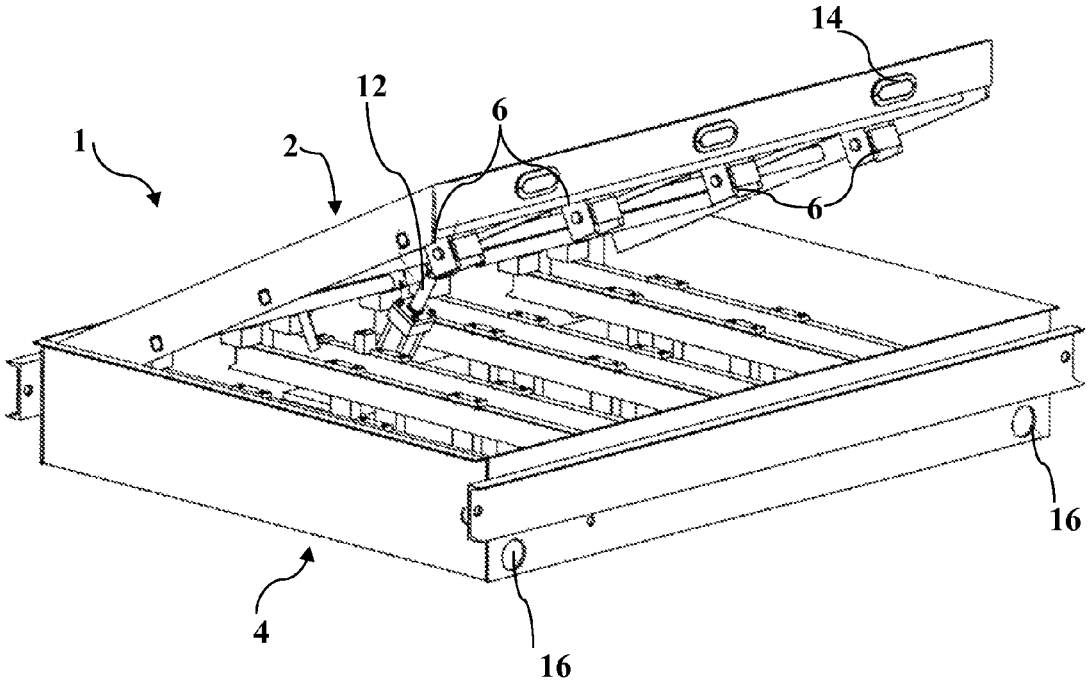
FIG. 3 shows a perspective view of a wedge barrier in an open position with slings not shown according to an aspect of the present disclosure.

FIG. 3 shows a perspective view of a wedge barrier 1 in an open position with slings 8 not shown according to an aspect of the present disclosure. The top assemble 2 can be coupled to the upper sling connection 6, mechanism 12, and the bottom assembly 4. Apertures 16 can be coupled to the bottom assembly 4 and can allow fluids or gases to exit. A pump (which is not shown) can be coupled with the apertures to assist with removal. Reflectors 14 can be coupled to the top assembly 2, where the reflectors 14 alert oncoming drivers that wedge barrier 1 is in an open position. The alerts can be a blinking light that can change depending on the day or night or can change as a vehicle approaches closer to the wedge barrier 1. The alerts can also be sound based where the sound can change based on time of day or distance to a vehicle.

Figure 4:
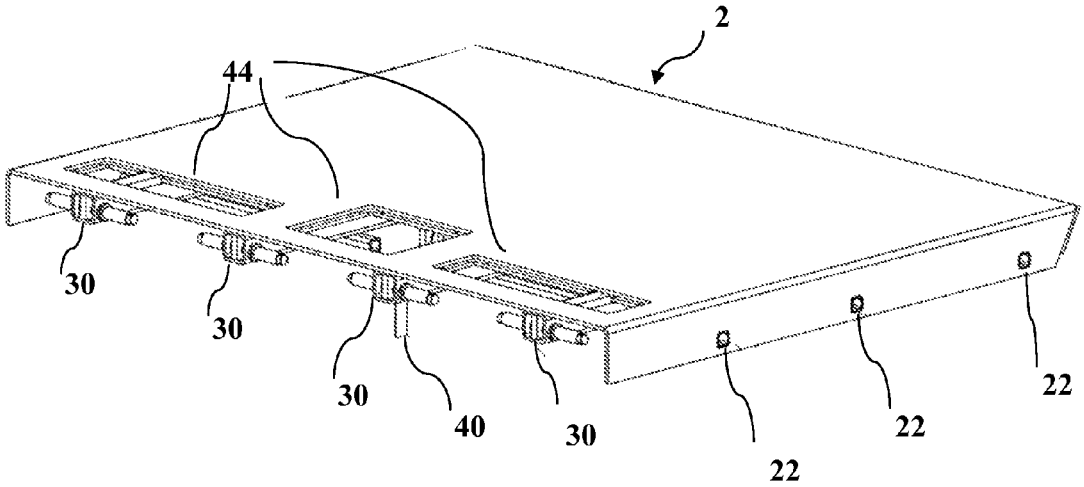
FIG. 4 shows a perspective view of a top assembly according to an aspect of the present disclosure.

FIG. 4 shows a perspective view of a top assembly 2 according to an aspect of the present disclosure. Cutouts 44 for removable access plates (not shown) allow for service access to components. Target 40 can be used by up proximity sensor 90 (shown in FIG. 11) and down proximity sensor 92 (also shown in FIG. 11) to determine the position of top assembly 2. The shaft tube assemblies 30 and lower tube braces 22 are discussed in FIGS. 5 and 6 below.

Figure 5A:
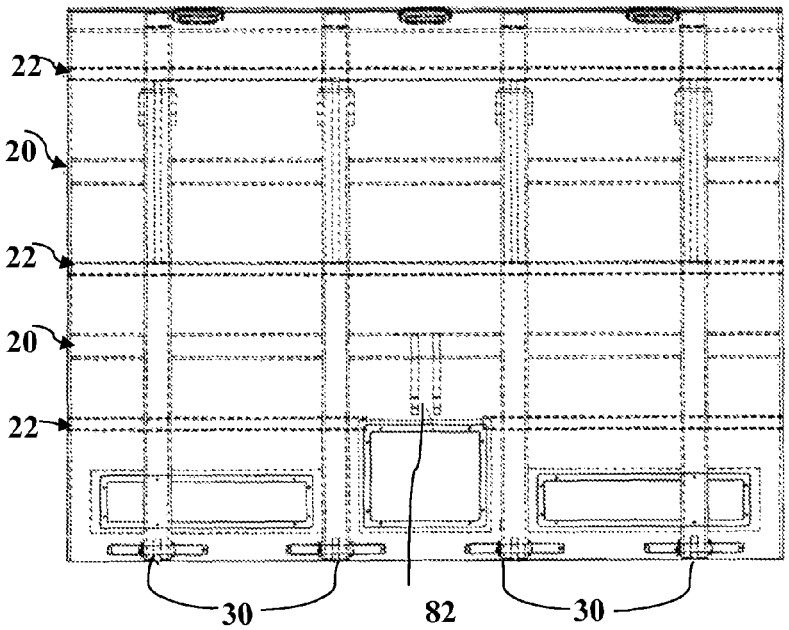
FIGS. 5A and 5B show bottom cross-section and side cross-section views, respectively, of a top assembly according to an aspect of the present disclosure.
Figure 5B:
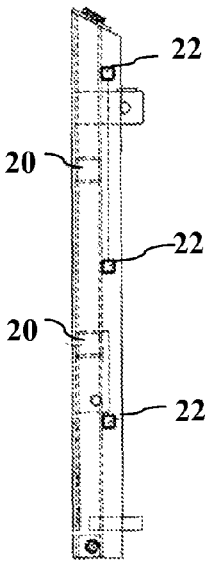

FIGS. 5A and 5B show bottom cross-section and side cross-section views, respectively, of top assembly 2 according to an aspect of the present disclosure. FIGS. 5A and 5B show top assembly 2 to which can be coupled are one or more upper tube braces 20 and lower tube braces 22, which can provide support and can run in parallel. Also shown are shaft tube assemblies 30 (discussed further in FIGS. 6A-6D) which can be perpendicular to the upper tube braces 20 and lower tube braces 22.

Figure 6A:
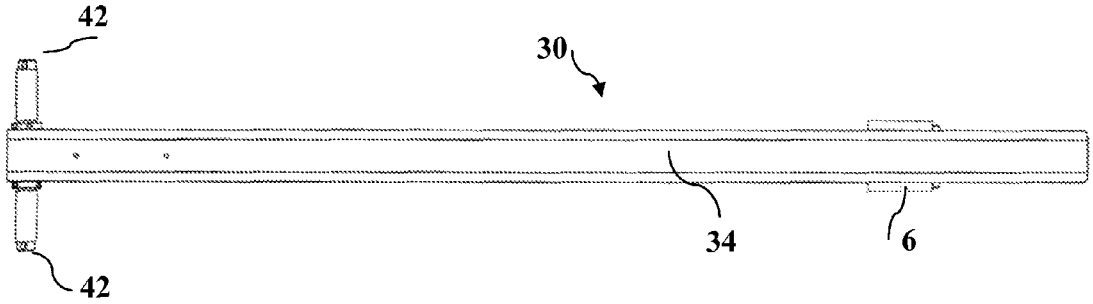
FIGS. 6A-6D show views of a shaft tube assembly according to an aspect of the present disclosure.
Figure 6B:
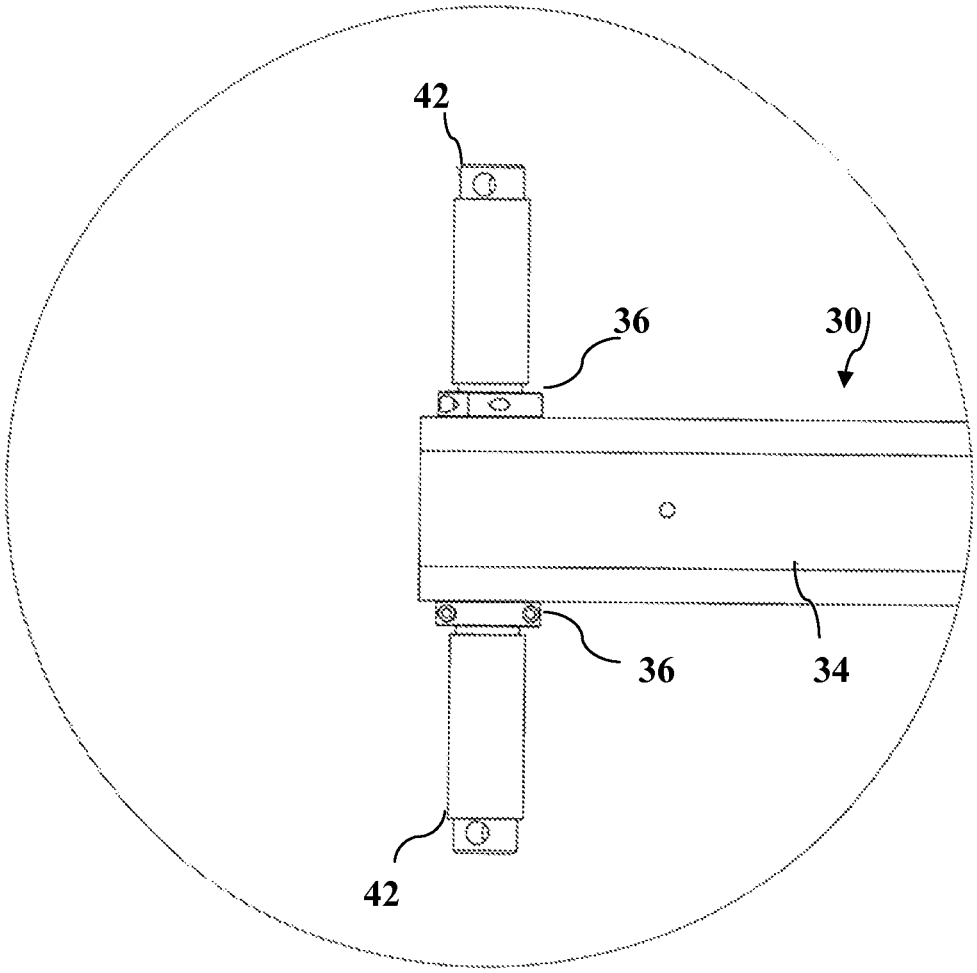
Figure 6C:
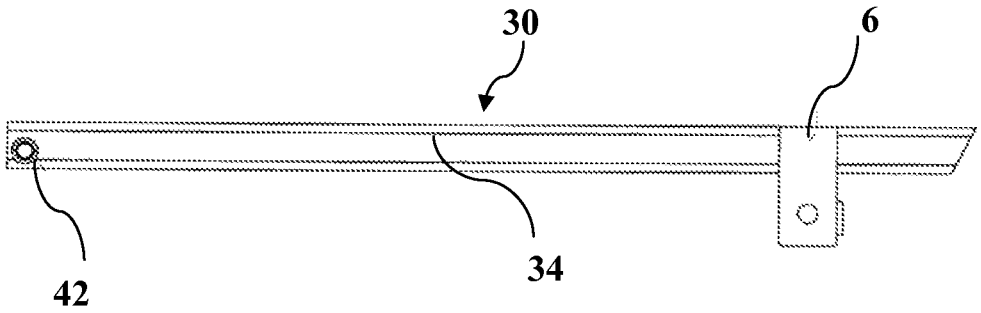
Figure 6D:
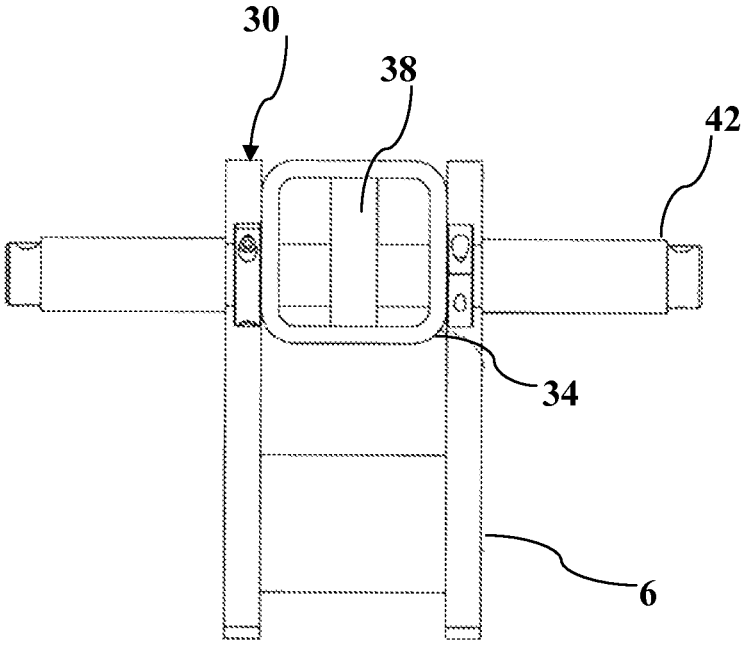

FIGS. 6A-6D show views of a shaft tube assembly 30 according to an aspect of the present disclosure. FIG. 6A shows in one aspect a shaft tube assembly 30 with shaft 34, having pivot bars 42, coupled to the upper sling connection 6 at a distal end. FIG. 6B in another aspect shows the two pivot bars 42 coupled to collar and bearings 36, which engage with a corresponding pair of bearing blocks 62 (shown in FIG. 7) and act as a pivot upon which top assembly 2 rotatably opens and closes. Also shown in FIG. 6B is the shaft 34 coupled to the collar and bearings 36 and pivot bars 42. FIG. 6C shows how in one aspect the shaft tube assembly 30 can be coupled to the upper sling connection 6 at a distal end. FIG. 6D in a another aspect shows a shaft stiffener 38 coupled to shaft tube assembly 30, pivot bars 42, shaft 34, and upper sling connection 6.

Figure 7:
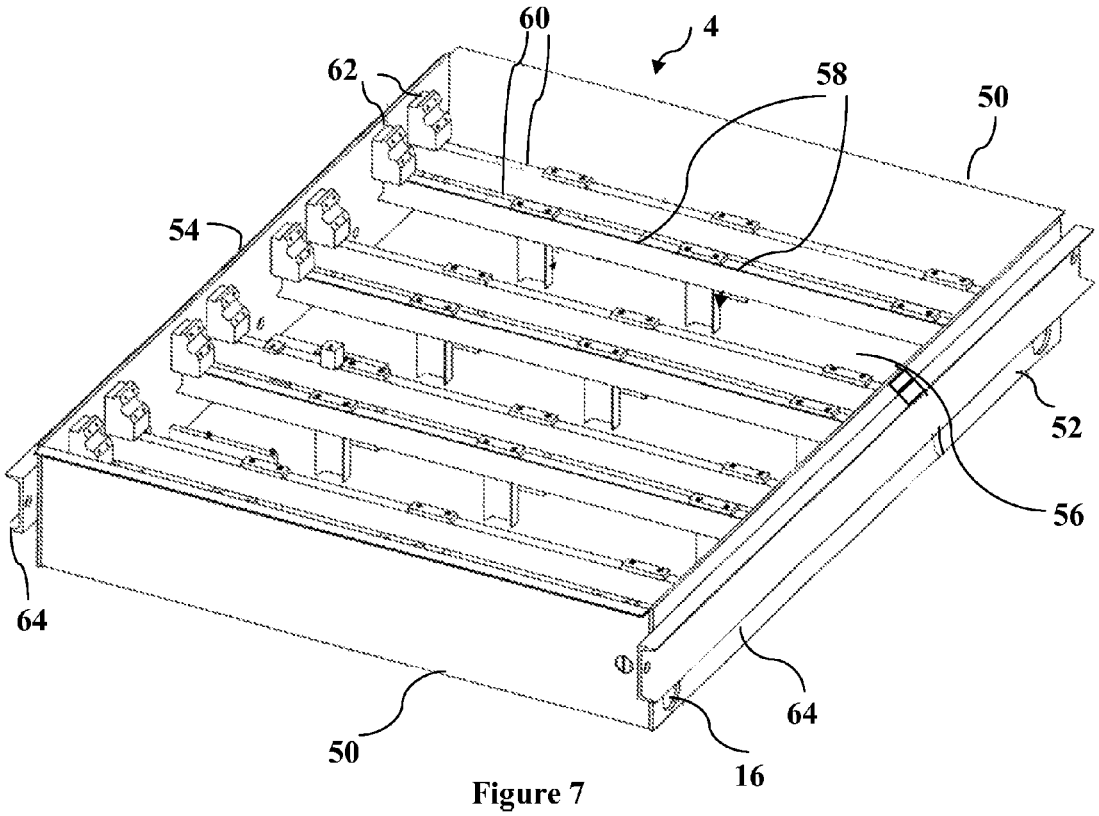
FIG. 7 shows a perspective view of a bottom assembly according to an aspect of the present disclosure.

FIG. 7 shows a perspective view of a bottom assembly 4 according to an aspect of the present disclosure. Bottom assembly 4 may include bottom side panels 50, bottom front panel 52, bottom rear panel 54, and bottom base panel 56. Bearing blocks 62, described above, are coupled to bottom rear panel 54 and are supported by channels 60. Channels 60 can be above the bottom base panel 56, for example, to a height approximately equal to grade by channel supports 58. Channels 60 add structural support for both traffic and impact loads. C-channels 64 connect bottom assembly 4 to a concrete foundation and provide strength to the bottom assembly 4 to support traffic loads and impact loads. In one aspect, bottom assembly 4 may be placed approximately 18" in ground.

Figure 9:
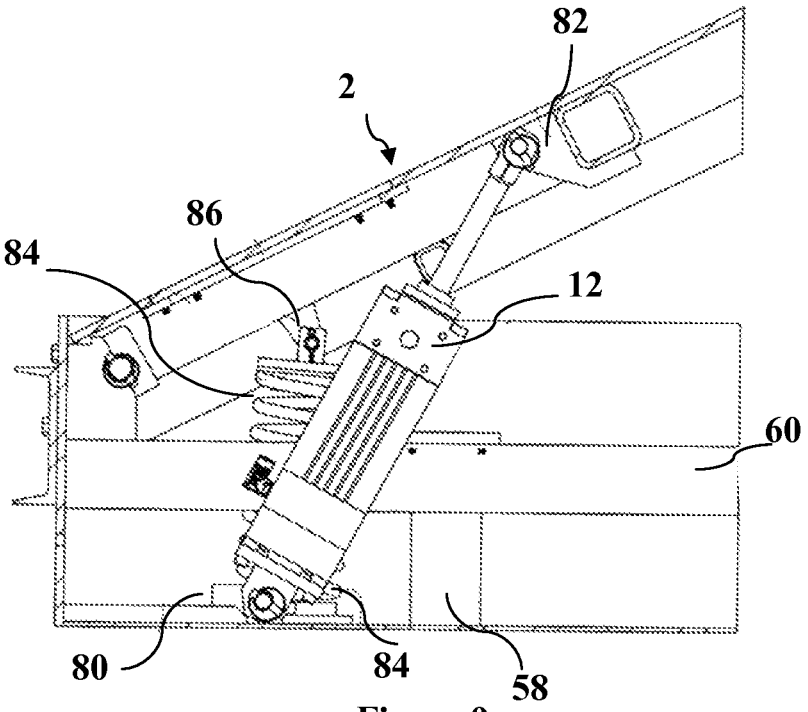
FIG. 9 shows a side cross-section view of an electrical raising and lowering mechanism according to an aspect of the present disclosure.

FIG. 8 shows a side cross-section view of a hydraulic mechanism 12 according to an aspect of the present disclosure. FIG. 9 shows a side cross-section view of an electrical mechanism 12 according to an aspect of the present disclosure. In each case, mechanism 12 can be coupled to bottom assembly 4 (not shown in either figure) and plate foundation 80. The channel supports 58 and channels 60 can also be coupled to the bottom assembly 4. A distal mechanism 12 may be coupled to tab 82, which may be part of top assembly 2. In FIG. 8, bearing blocks 62 can be coupled to top assembly 2. In FIG. 9, electrical mechanism 12 may be assisted by spring 84, the ends of which may be coupled to foundation 80 and spring tab 86.

Figure 10:
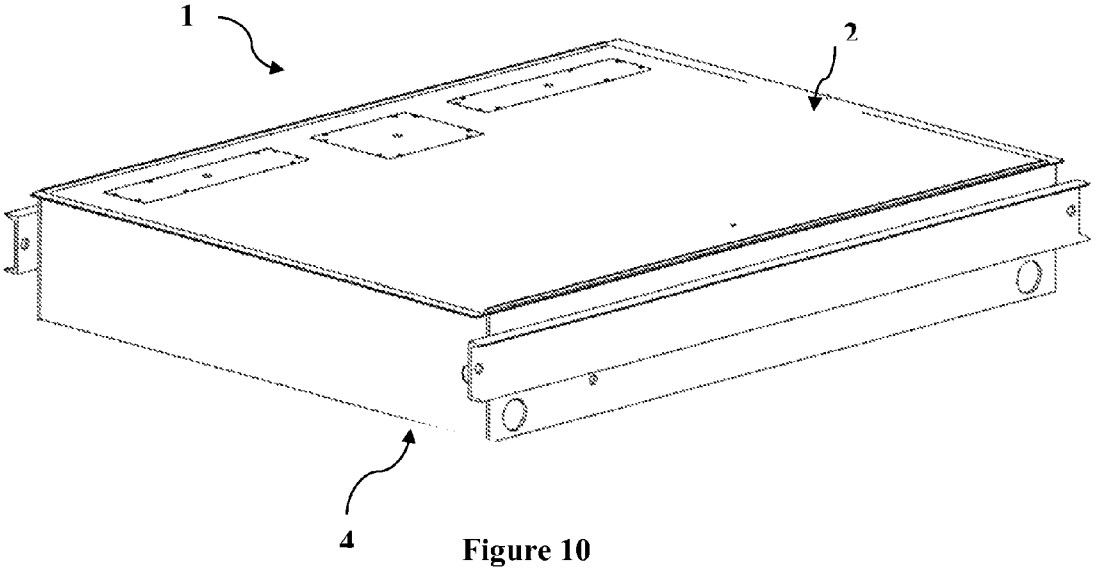
FIG. 10 shows a perspective view of a wedge barrier in a closed position according to an aspect of the present disclosure.

FIG. 10 shows a perspective view of a wedge barrier 1 in a closed position according to an aspect of the present disclosure. In the closed position, the top assembly 2 is shown coupled to bottom assembly 4. In this position, a vehicle may pass overtop wedge barrier with little or no incident.

Figure 11:
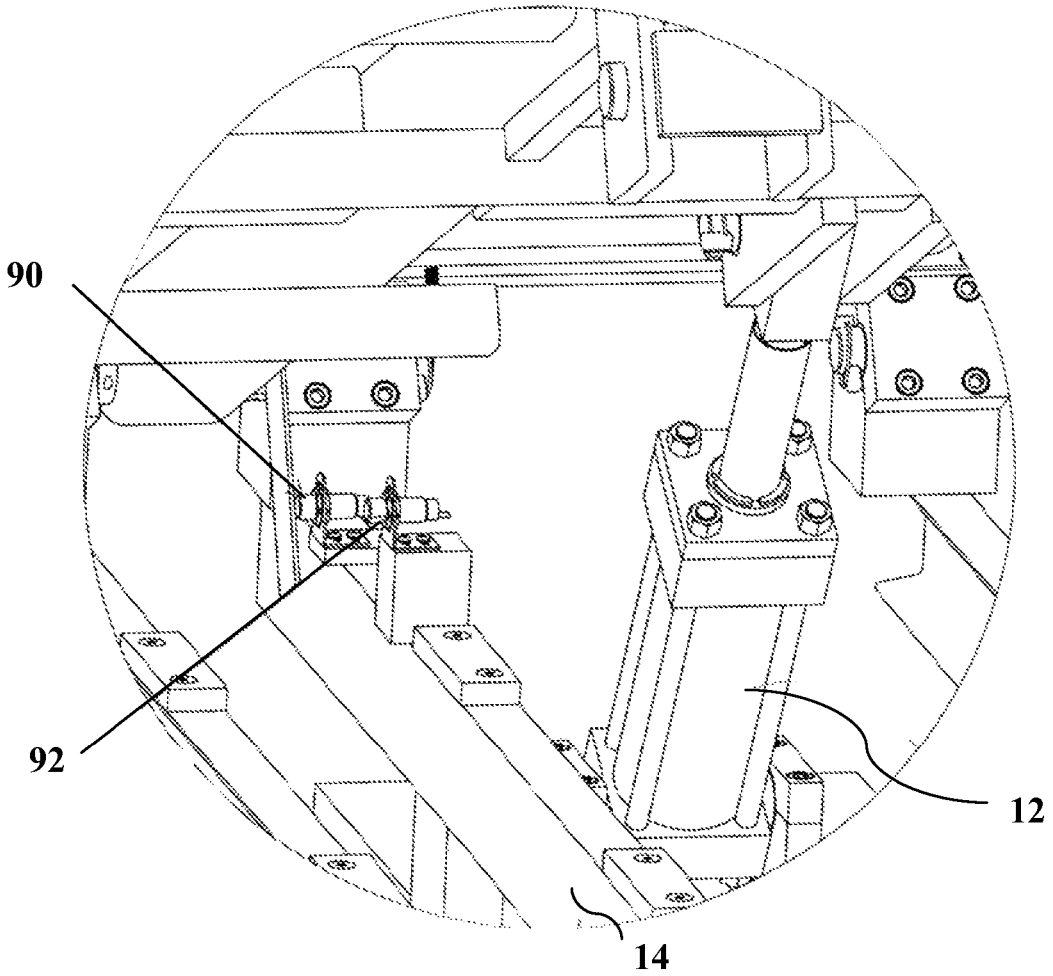
FIG. 11 shows a perspective view of proximity sensors in an interior of a wedge barrier according to an aspect of the present disclosure.

FIG. 11 shows a perspective view of proximity sensors in an interior of a wedge barrier according to an aspect of the present disclosure. Target 40 (not shown) can be used by up proximity sensor 90 and down proximity sensor 92 to determine the position of top assembly 2. Also shown are the mechanism 12 and reflectors 14.

Figure 12:
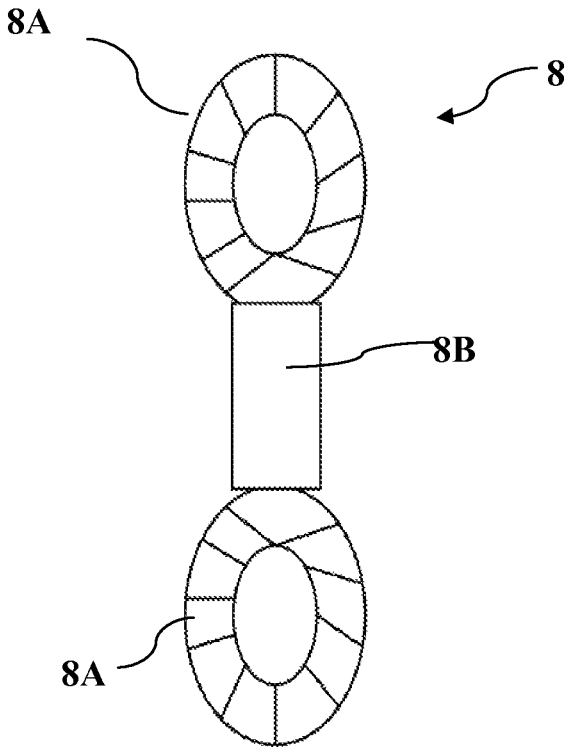
FIG. 12 shows a front view of a sling according to an aspect of the present disclosure.

FIG. 12 shows a front view of a sling 8 according to an aspect of the present disclosure. Two loop ends 8A are shown. Loop ends 8A may be in a further aspect covered in weather and wear resistant material 8B. Unless otherwise specified, substantially all materials used herein may be fabricated of high-strength metal, such as steel.

Test Data

Along with the other disclosures provided herein, the following test data is also separately illustrative of the innovative barrier system disclosed herein. A wedge barrier having, for example, slings 8 according to the present disclosure was impacted by an International 4700 single-unit medium-duty flatbed truck according to ASTM F2656-07 M50 standards. In this sample test, the wedge barrier was 9 feet wide, having installation dimensions of 109 inches by 86 inches, installed in concrete foundation. The 9 feet wedge barrier also demonstrated 30 full cycles and an Emergency Fast Operation (or "EFO") speed of less than 2 seconds. Noise data was measured 10 feet away from the edge of the wedge as it cycled. The average sound level measured during the up motion was 65 dBa, with a peak of 95 dBa at the moment the wedge closed. The vehicle had a mass of 15,050 lb and impacted the wedge at 90.1 degrees with the centerline of the vehicle aligned with that of the wedge.

After impacting the wedge barrier 1, the vehicle was brought to a stop and disabled. The cargo remained onboard the vehicle, and the hood of the vehicle became detached and was thrown forward beyond the inside edge of the wedge. The leading edge of the cargo bed of the vehicle did not penetrate beyond the inside edge of the wedge. This wedge satisfied ASTM F2656-07 Condition/Penetration Rating M50/P1, which allows penetration of less than or equal to 3.3 feet when impacted by a medium-duty truck at 50 mph.

As another example, a 16 feet wedge system was tested. A 2000 International 4700 single-unit flatbed truck weighing 15,160 lb impacted the 16 feet wedge system at approximately 90 degrees, with the centerline of the vehicle aligned with the centerline of the 16 feet wedge system. After impacting the wedge barrier 1, the 16 feet wedge system brought the vehicle to a stop. The cargo remained onboard the vehicle. The vehicle was disabled. Numerous additional modifications and variations of the present disclosure are possible in view of the above teachings. It is therefore to be understood that within the scope of the appended claims, the present disclosure may be practiced other than as specifically described herein.

The invention claimed is:

1. A wedge-shaped vehicle barrier, comprising:

a top assembly pivotably coupled to a bottom assembly;

a mechanism coupled to the top assembly and coupled to the bottom assembly, where the mechanism moves the top assembly between a first position that is substantially horizontal and a second position at a first angle, the mechanism for repeatedly cycling the top assembly between the first position and the second position; and one or more flexible slings coupled to a distal portion of the top assembly and a distal portion of the bottom assembly, where the one or more slings prevent the top assembly from rotating beyond a second angle when the top assembly is engaged by a vehicle, the second angle being greater than or equal to the first angle, wherein each sling comprises synthetic fiber that is wound into a continuous loop, wherein a portion of the loop is encased in one or more layers of a wear resistant material to couple the sling to itself at a first point near a first end to form a first loop end, at a second point near a second end to form a second loop end, and at a third point between the first and second points, and wherein the first loop end is coupled to the top assembly and the second loop end is coupled to the bottom assembly.

2. The wedge barrier of claim 1, wherein the sling comprises synthetic fiber that is twisted with one or more other types of fibers, where the twisted combination are wound.

3. The wedge barrier of claim 2, wherein the twisted combination are in parallel with the direction of the vehicle.

4. The wedge barrier of claim 3, wherein the twisted combination in parallel with the direction of the vehicle are located on different planes.

5. The wedge barrier of claim 1, wherein the sling comprises synthetic fiber that is twisted with one or more other types of fibers, where the twisted combination are wound between a first pin on the top assembly and a second pin on the bottom assembly.

6. The wedge barrier of claim 1, wherein the sling is at least partially encased between the first and second points in one or more layers of protective flexible material.

7. The wedge barrier of claim 1, wherein the bottom assembly is fixed in the ground and at least partially below grade.

8. The wedge barrier of claim 1, wherein the movement of the mechanism from the first position to the second position is between 65 dBa and 95 dBa.

9. The wedge barrier of claim 1, wherein the distance from the pivotably coupled top and bottom assembly to the one or more flexible slings coupled to the distal portion of the top assembly is such that reduced power is needed to raise the top assembly.

10. The wedge barrier of claim 1, wherein the vehicle engaged to the top assembly causes the vehicle's load to be uniformly distributed across the top assembly.

11. The wedge barrier of claim 1, wherein the mechanism moves the top assembly between the first position and the second position at a speed of less than two seconds.

12. A wedge-shaped vehicle barrier having a top assembly coupled to a bottom assembly, and a mechanism coupled to the top assembly and the bottom assembly, where the mechanism moves the top assembly between a first position that is substantially horizontal and a second position at a first angle, the mechanism for repeatedly cycling the top assembly between the first position and the second position, comprising:

one or more flexible slings coupled to a distal portion of the top assembly and a distal portion of the bottom assembly, where the one or more slings prevent the top assembly from moving beyond a second angle when the top assembly has a load applied, the second angle being greater than or equal to the first angle, wherein each sling comprises synthetic fiber that is wound into a continuous loop and wherein a portion of the loop is encased in one or more layers of a wear resistant material to couple the sling to itself at a first point near a first end to form a first loop end, at a second point near a second end to form a second loop end, and at a third point between the first and second points, and wherein the first loop end is coupled to the top assembly and the second loop end is coupled to the bottom assembly.

13. The wedge barrier of claim 12, wherein the sling comprises synthetic fiber that is twisted with one or more other types of fibers, where the twisted combination are wound.

14. The wedge barrier of claim 13, wherein the twisted combination are in parallel with the direction of the load.

15. The wedge barrier of claim 12, wherein the sling comprises synthetic fiber that is twisted with one or more other types of fibers, where the twisted combination are wound between a first pin on the top assembly and a second pin on the bottom assembly.

16. The wedge barrier of claim 12, wherein the sling is at least partially encased between the first and second points in one or more layers of protective flexible material.

17. The wedge barrier of claim 12, wherein the movement of the mechanism from the first position to the second position is between 65 dBa and 95 dBa.

18. The wedge barrier of claim 12, wherein the mechanism moves the top assembly between the first position and the second position at a speed of less than two seconds.

19. A wedge-shaped vehicle barrier, comprising:

a top assembly pivotably coupled to a bottom assembly;

a mechanism coupled to the top assembly and coupled to the bottom assembly, where the mechanism moves the top assembly between a first position that is substantially horizontal and a second position at a first angle, the mechanism for repeatedly cycling the top assembly between the first position and the second position; and one or more flexible slings coupled to a distal portion of the top assembly and a distal portion of the bottom assembly, where the one or more slings prevent the top assembly from rotating beyond a second angle when the top assembly is engaged by a vehicle, the second angle being greater than or equal to the first angle, wherein each sling comprises synthetic fiber that is wound into a continuous loop, wherein a portion of the loop is encased in one or more layers of an elongate material to couple the sling to itself at a first point near a first end to form a first loop end, at a second point near a second end to form a second loop end, and at a third point between the first and second points, and wherein the first loop end is coupled to the top assembly and the second loop end is coupled to the bottom assembly.

20. The wedge barrier of claim 19, wherein the sling comprises synthetic fiber that is twisted with one or more other types of fibers, where the twisted combination are wound.

21. The wedge barrier of claim 20, wherein the twisted combination are in parallel with the direction of the vehicle.

22. The wedge barrier of claim 21, wherein the twisted combination in parallel with the direction of the vehicle are located on different planes.

23. The wedge barrier of claim 19, wherein the sling comprises synthetic fiber that is twisted with one or more other types of fibers, where the twisted combination are wound between a first pin on the top assembly and a second pin on the bottom assembly.

24. The wedge barrier of claim 19, wherein the sling is at least partially encased between the first and second points in one or more layers of protective flexible material.

25. The wedge barrier of claim 19, wherein the bottom assembly is fixed in the ground and at least partially below grade.

26. The wedge barrier of claim 19, wherein the movement of the mechanism from the first position to the second position is between 65 dBa and 95 dBa.

27. The wedge barrier of claim 19, wherein the distance from the pivotably coupled top and bottom assembly to the one or more flexible slings coupled to the distal portion of the top assembly is such that reduced power is needed to raise the top assembly.

28. The wedge barrier of claim 19, wherein the vehicle engaged to the top assembly causes the vehicle's load to be uniformly distributed across the top assembly.

29. The wedge barrier of claim 19, wherein the mechanism moves the top assembly between the first position and the second position at a speed of less than two seconds.

30. A wedge-shaped vehicle barrier having a top assembly coupled to a bottom assembly, and a mechanism coupled to the top assembly and the bottom assembly, where the mechanism moves the top assembly between a first position that is substantially horizontal and a second position at a first angle, the mechanism for repeatedly cycling the top assembly between the first position and the second position, comprising:

one or more flexible slings coupled to a distal portion of the top assembly and a distal portion of the bottom assembly, where the one or more slings prevent the top assembly from moving beyond a second angle when the top assembly has a load applied, the second angle being greater than or equal to the first angle, wherein each sling comprises synthetic fiber that is wound into a continuous loop and wherein a portion of the loop is encased in one or more layers of an elongate material to couple the sling to itself at a first point near a first end to form a first loop end, at a second point near a second end to form a second loop end, and at a third point between the first and second points, and wherein the first loop end is coupled to the top assembly and the second loop end is coupled to the bottom assembly.

31. The wedge barrier of claim 30, wherein the sling comprises synthetic fiber that is twisted with one or more other types of fibers, where the twisted combination are wound.

32. The wedge barrier of claim 31, wherein the twisted combination are in parallel with the direction of the load.

33. The wedge barrier of claim 30, wherein the sling comprises synthetic fiber that is twisted with one or more other types of fibers, where the twisted combination are wound between a first pin on the top assembly and a second pin on the bottom assembly.

34. The wedge barrier of claim 30, wherein the sling is at least partially encased between the first and second points in one or more layers of protective flexible material.

35. The wedge barrier of claim 30, wherein the movement of the mechanism from the first position to the second position is between 65 dBa and 95 dBa.

36. The wedge barrier of claim 30, wherein the mechanism moves the top assembly between the first position and the second position at a speed of less than two seconds.

* * * * *